US005172836A

United States Patent [19]

Warner

[11] Patent Number: 5,172,836

[45] Date of Patent: Dec. 22, 1992

[54] ERGONOMIC TRIGGER SPRAYER AND HAND POSITIONER THEREFOR

[75] Inventor: Jim Warner, New York, N.Y.

[73] Assignee: The Drackett Company, Cincinnati, Ohio

[21] Appl. No.: 712,019

[22] Filed: Jun. 7, 1991

[51] Int. Cl.[5] ..... B67D 5/40

[52] U.S. Cl. ..... 222/383; 222/465.1

[58] Field of Search ..... 222/383, 323, 324, 465.1, 222/471, 474; D9/300, 409, 378-383

[56] References Cited

U.S. PATENT DOCUMENTS

| | | | |
|---|---|---|---|
| 4,138,038 | 2/1979 | Grogan | 222/472 X |
| 4,220,285 | 9/1980 | Gualdi | 222/383 X |
| 4,273,268 | 6/1981 | Wickenberg | 222/383 |
| 4,434,917 | 3/1984 | Saito et al. | 222/383 |
| 4,603,812 | 8/1986 | Stoesser et al. | 222/383 X |
| 4,618,077 | 10/1986 | Corsette | 222/383 |
| 4,781,311 | 11/1988 | Dunning et al. | 222/383 X |
| 4,971,227 | 11/1990 | Knickerbocker et al. | 222/383 X |

*Primary Examiner*—Kevin P. Shaver
*Assistant Examiner*—Kenneth DeRosa
*Attorney, Agent, or Firm*—Charles Zeller

[57] ABSTRACT

An ergonomic trigger sprayer comprising a spraying mechanism including a nozzle and a trigger for connection to a container holding the liquid; a housing having a mounting portion for attachment to the container, the housing enclosing the spraying mechanism when mounted to the container and having opposed front and rear ends, and a hand positioner affixed to the rear portion of the housing. The hand positioner is for providing pressure contact with the dorsal web of the hand of a user between the thumb and the index finger when the user grips the container and pulls the trigger so that the container and the hand and wrist of a user are held in substantial alignment during spraying operations. The hand positioner includes a bottom wall that is in pressure contact with the dorsal web of the hand of the user during spraying operations.

19 Claims, 6 Drawing Sheets 71
110
112
114
102

5
54X
66X
66
54A
34A
83

88
92
90
6
4
4
82
86
5
12A
28A
98
100
110
44
78
64
64X
46
6

ERGONOMIC TRIGGER SPRAYER AND HAND POSITIONER THEREFOR

FIELD OF THE INVENTION

This invention relates to a trigger-type liquid sprayer having increased ergonomic efficiency. The invention also relates to an ergonomic hand positioner affixed to a conventional trigger sprayer housing for a trigger sprayer following modifications that increases the ergonomic efficiency of the trigger sprayer.

BACKGROUND OF THE INVENTION

Conventional trigger sprayers include a housing enclosing a pump mechanism and having a mounting portion on its bottom side which connects with a cap threaded to a container holding a typically liquid composition. A trigger for operating the pump extends downwards under the housing and a nozzle extends from under the front end of the housing. A user grips the container, aims the nozzle, and with the index finger pulls the trigger. In many conventional trigger sprayers, for example Model No. T-7500 sold by Continental Sprayer, Inc., illustrated in FIG. 1, the rear of the housing, i.e., that portion of the housing extending outwardly from the mounting portion, fails to provide a meaningful receiving surface for the web portion of the user's hand between the thumb and index finger. Thus, in the trigger sprayer shown in FIG. 1 by the numeral 10, the truncated rear portion 15 of the housing 12 is seen to extend upwardly from the mounting portion 24 to intersect a downwardly sloping top wall portion 17 in a truncated fashion. The depth of the rear portion, measured from the mounting portion to the intersection of the upwardly and downwardly sloping walls is too small to be useful to the user during operation to provide any measure of support for the weight of the container, including its contents.

Such housing construction, in particular the construction of the rear of the housing, is at least in part a result of the nature of the molding procedure for the housing. Thus, the rear of the housing in the trigger sprayer 10 of FIG. 1 comprises opposed side wall segments 19 and the sloping top wall segment 17 defining a recess 28 that extends well into the housing. Recess 28 is formed during molding by a retractable plug, limitations on the size of the recess being a function of molding speed, shape, heat dissipation, and the like.

As a result such conventional housings having a truncated rear housing portion are poorly adapted to facilitate ease of spraying by the user. Thus, the rear portion of this conventional housing does not engage the web of the user's hand between the thumb and index finger. As a result the palm and fingers of the hand must tightly grasp the container/trigger sprayer assembly, and bear the weight of the liquid composition in the container. In so doing the wrist is often bent. The result is that the muscles of the hand control most of the load of the sprayer. In addition, the hand tends to slide and shift. It is noted that during extensive spraying the muscles of the hand can tire because of the difficulty of maintaining the direction of the nozzle of the sprayer at objects.

SUMMARY OF THE INVENTION

Accordingly, it is an object of this invention to improve the ergonomic efficiency of a trigger sprayer. The ergonomic efficiency is improved by attaining a neutral hand position, which in particular is a substantial linear alignment of a sprayer nozzle and the hand, wrist, and forearm of a user would attain substantial linear alignment.

Accordingly, it is an object of this invention to provide a hand positioner for a conventional trigger-type liquid sprayer having a truncated rear housing portion to increase its ergonomic efficiency, that is, to effect a reduction in the stress to those muscles associated with spraying.

It is also an object of this invention to provide a trigger-type liquid sprayer that includes an ergonomic hand positioner that seats against the top, or dorsal side, of the web of the hand between the thumb and index finger of a user during spraying operations, whereby the sprayer nozzle and the user's hand and wrist are more nearly aligned in a straight-line configuration, which increases the ease of spraying and the comfort of the user during spraying operations and hence the comfort of the user during spraying operations, i.e., the ergonomic suitability of the trigger sprayer.

It is a further object of this invention to provide an ergonomic hand positioner extending from the rear of a housing for a trigger-type liquid sprayer, the hand positioner being seated in pressure contact with the dorsal web of the hand between the thumb and the index finger of a user during spraying operations so that a generally aligned relation between the sprayer and the hand and wrist of the user results, namely, that the spray nozzle and the hand and wrist lie in a plane with the following results: that the user's hand is easily maintained at the aiming position of the nozzle and the larger muscles of the arm carry much of the load of the liquid sprayer rather than the muscles of the hand.

As a corollary object of the present invention, the ergonomic hand positioner facilitates maintenance of the user's hand in the aiming position of the nozzle, whereby the larger muscles of the arm carry much of the load of the liquid sprayer rather than the muscles of the hand.

It is a primary object of this invention to provide a secondary ergonomic hand positioner attached to the rear end of a conventional, i.e., truncated, housing of an existing trigger type-liquid sprayer, the hand positioner being seated in pressure contact with the dorsal web of the hand between the thumb and index finger of a user during spraying operations so that a generally straight-line relationship is attained between the sprayer nozzle and the user's hand and wrist, thereby increasing the ergonomic efficiency of the sprayer.

In accordance with these and other objects which will become apparent hereinafter, there is provided in accordance with the present invention an ergonomic trigger sprayer for connection to a container for holding a liquid composition comprising a spraying mechanism including a nozzle and a trigger; a housing having mounting means for attachment to the container, the housing enclosing the spraying mechanism and having opposed front and rear ends, and a hand positioner affixed to the rear portion of the housing. The hand positioner provides in pressure contact with the dorsal web of the hand of a user between the thumb and the index finger when the user grips the container and pulls the trigger so that the container and the hand and wrist of a user are held in substantial alignment during spraying operations. The hand positioner thus includes a bottom wall for establishing pressure contact with the dorsal web of the hand of the user during spraying operations. Preferably, the hand positioner has an inwardly arcuate bottom wall, providing thereby a surface generally conforming to the shape of the user's dorsal web, the edge of this arcuate bottom wall distal the container mounting portion preferably being approximately at the same height or below the arcuate bottom wall edge proximate the mounting portion.

There is also provided in accordance with the present invention an ergonomic trigger sprayer comprising:

(a) a housing for covering the spraying mechanism for the trigger sprayer, the housing having a truncated rear portion defining a recess at its rear end including a first connecting element; and (b) a separate hand-positioning member having a bottom wall connected to a downwardly angled top wall, the bottom and top walls being connected to opposed vertical walls, and having a second connecting element.

The hand-positioning member is insertible into the recess of the housing until the first and second connecting elements interlock so that the separate hand-positioning member is non-removably joined to the housing, whereby the hand-positioning member achieves pressure contact with the dorsal web of the hand of a user between the thumb and the index finger when the user grips the housing and the container to which the housing will be attached, the trigger sprayer and the hand and wrist of the user then being held in substantial alignment during the spraying operation.

In considering the problem of improving the ergonomic efficiency of a conventional trigger sprayer of the aforementioned type having a truncated or foreshortened rear housing portion, several factors were investigated. First, the cost of manufacturing a separate hand-positioner piece and modifying the conventional housing and thereafter assembling a final housing by attaching the hand-positioner piece to the modified housing in accordance with the present invention was compared with the cost associated with providing a new, or customized, unitary housing that included an extended ergonomically useful rear housing portion. Second, difficulties in engineering the two concepts were explored. Lastly, the ability to timely effect the two concepts were considered. The result of such analysis discloses that manufacture of the ergonomic housing by means of assembling a separate hand positioner with a modified conventional housing is the most advantageous, as outlined below.

ADVANTAGES OF USING THE SEPARATE HAND POSITIONER

I. Unit Cost

The separate hand-positioner trigger sprayer would cost one-quarter to one half less per unit more than the unitary customized housing would cost.

II. Reduced Plastic Mold Costs

Total mold costs for the separate hand-positioner trigger sprayer including housing modifications would be about one quarter the total model costs for the unitary customized housing. Advantageously, all housing mold modifications to the existing housing molds would b reversible.

III. Ability to Use Existing Trigger Sprayer Assembly Equipment

The trigger sprayer incorporating the separate hand-positioning member can be assembled on existing assembly equipment with the addition of a new assembly station. New assembly equipment for the unitary type trigger sprayer would be required.

IV. Ability to Vary the Design of the Separate Hand-Positioner Type Trigger Sprayer The height and the degree of the preferred inwardly arcuate bottom surface of the separate hand-positioning member (which rests on the dorsal web of the hand of the user) can be more pronounced than that for the unitary hand-positioner type trigger sprayer because of molding limitations of the latter. Furthermore, replacement cost of the separate hand-positioning member type trigger sprayer is considerably less than for the unitary trigger sprayer.

V. Timing

Total development timing for the separate hand-positioning member type trigger sprayer is significantly less than the time to develop the unitary hand-positioner type trigger sprayer. Furthermore, the time needed to qualify and debug the new molds for the unitary type trigger sprayer would be greater than for the time needed for the molds for the separate hand-positioning member trigger sprayer.

The advantages of the present invention are further illustrated by research conducted using a prototype rubber piece as a hand positioner. The rubber piece was wedged into the underlying rear housing recess of Model T-7500 trigger sprayer. A total of 253 respondents participated in this test, who were requested to provide their assessment of the prototype trigger sprayer described above as compared to the Model T-7500 trigger sprayer not having the hand positioner. The results of this research demonstrated that the trigger sprayer with the prototype hand positioner was significantly preferred to the conventional trigger sprayer, as the data provided below substantiates.

| Overall Preference After Using: | Percent |
|---|---|
| Prefer Conventional Sprayer | 18 (S) |
| Prefer Hand-Positioner Sprayer Prototype | 71 (S) |
| No Preference | 11 |
| | 100 |
| Fit More Comfortably in the Hand | |
| Conventional Sprayer | 19 (S) |
| Hand-Positioner Sprayer Prototype | 69 (S) |
| No Preference | 12 |
| | 100 |
| Less Tiring to Use | |
| Conventional Sprayer | 20 (S) |
| Hand-Positioner Sprayer Prototype | 71 (S) |
| No Preference | 9 |
| | 100 |

In the above tables (S) indicates a significant difference between the tested sprayers at a 95% confidence level.

Prior Art

U.S. Pat. No. 4,819,835 to Tasaki discloses a trigger-type liquid dispenser having housing body 6 with a nozzle 1 at its front end and an extension (no numeral) unitary with the housing body opposed to the nozzle at its rearward end. The purpose of the unitary extension is not described.

It is evident from FIGS. 2, 5, 6, and 9 of Tasaki that the unitary housing-extension has an open bottom side, and parallel edges of the extension would be in contact with the user's hand rather than a full wall as in the present invention. In addition, the unitary housing shown by Tasaki is seen to have an exceptionally deep recess. During manufacture it is incumbent on Tasaki that the plug which forms this deep recess be removed in a manner that does not compromise the integrity of the housing. Generally, this requires great precision of the molding operation, and likely requires operation at slower speeds than occasioned by the Continental Sprayer, Inc. sprayer mentioned previously. It is noted that to make a pronounced deep recess for the underside of the Tasaki housing-extension would be particularly difficult if not impossible because of difficulties of making a unitary mold that would produce a pronounced deep recess. It is further noted that in the present invention the distal end 66 of the hand positioner can be curved for the comfort of the user. In particular, a radius can be formed between top wall 80 and bottom wall 64, but such a radius would not be expected for Tasaki because of the difficulty in molding an article having an undercut, a condition known as a negative draft angle. In addition, the advantageous secondary "snap on", or custom shroud, shown and described in the present invention, which is mounted during the manufacturing process to a conventional housing for a trigger sprayer is not described or suggested by the various illustrations of the unitary housing-extension of Tasaki, which are all obviously molded in a unitary, or integral, process with the the housing.

DESCRIPTION OF THE PREFERRED EMBODIMENTS

Reference is now made to the drawings in which the same or similar elements are indicated by the same numerals.

Figure 1:
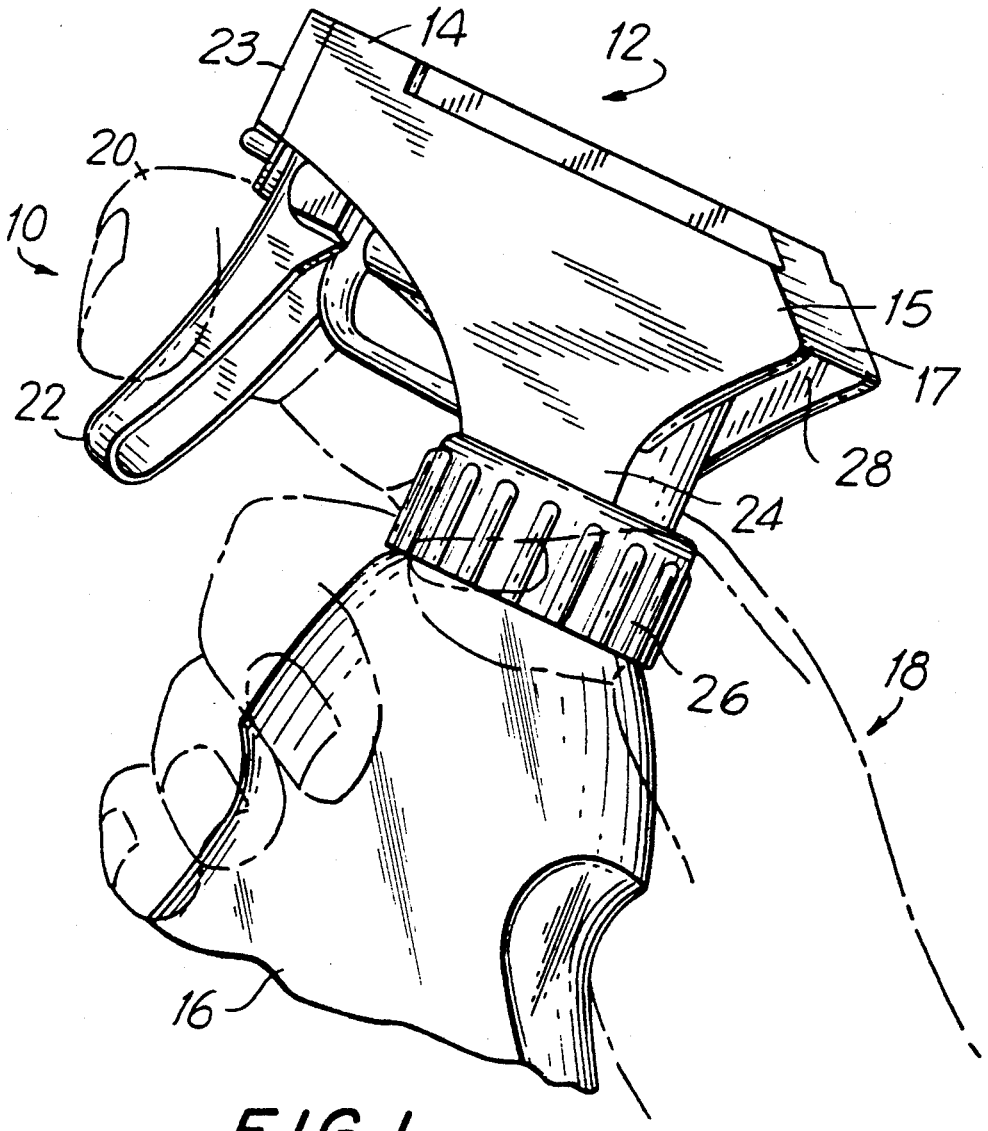
FIG. 1 PRIOR ART
FIG. 1 is a perspective view of a conventional prior art housing for a trigger sprayer including a hand of a user shown in phantom line.

A conventional prior art liquid sprayer 10 illustrated in FIG. 1 includes a prior art housing 12 having a front portion 14 and a truncated rear portion 15 connected to a container 16. Truncated rear portion 14 has a downwardly sloping top wall 17. The hand 18 of a user grips container 16 with the index finger 20 holding a trigger 22, which is covered by front portion 14 which encloses a nozzle 23. Rear end 15 extends slightly rearwards of a mounting portion 24 that is connected to a threaded cap 26 that is attached to container 16. Rear portion 15 of housing 12 defines a recess 28 which has a bottom side opening. Hand 18 is below and spaced from rear end 15 in the normal gripping position as indicated in FIG. 1. The distance from mounting portion 24 to the end of truncated rear portion 15 is approximately 0.64 inch.

Figure 2:
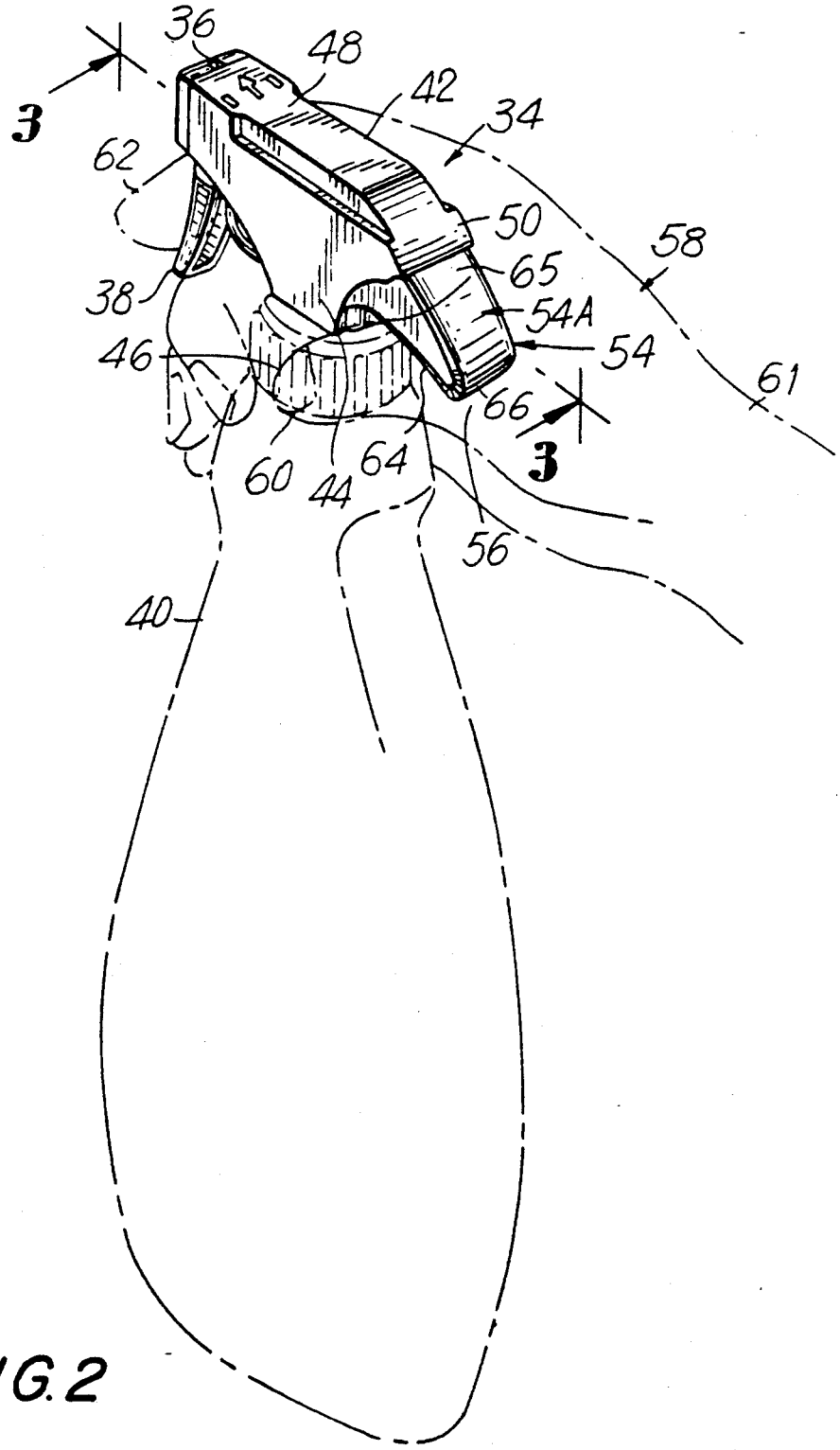
FIG. 2 is a perspective view of a liquid trigger-type sprayer mounted on a container, the housing enclosing the trigger mechanism having an ergonomic hand positioner in accordance with the teachings of the present invention, with the hand of a user gripping the housing and container shown in phantom line.

FIG. 2 illustrates an ergonomic trigger sprayer 34 in accordance with the present invention comprising a spraying mechanism (not illustrated) including a nozzle 36 and a trigger 38 connected to a container 40 for holding liquid. Ergonomic trigger sprayer 34 includes a housing 42 having a bottom mounting portion 44 attached to a threaded cap 46 shown in phantom line screwed onto container 40. Housing 42 encloses the spraying mechanism and has opposed front and rear portions 48 and 50, respectively, with front portion 48 covering trigger 38 and enclosing nozzle 36. Mounting portion 44 is located between front and rear portions 48 and 50.

A hand positioner 54 extending rearwards from rear portion 50 of housing 42 is in pressure contact with the dorsal web of the hand 58 of a user between the thumb 60 and the index finger 62 when the user grips trigger sprayer 34 and pulls trigger 38 with index finger 62. In this position container 40, hand 58 and wrist 61 of the user are normally held in a general straight-line alignment during spraying operations with much of the weight of trigger sprayer 34 including the liquid in container 40 being held u by dorsal web 56, which underlies hand positioner 54, so that an ergonomic increase of efficiency is achieved during spraying operations.

Hand positioner 54 is a projecting portion that extends rearwards to a range of distances distance from mounting portion 44 that when trigger sprayer 34 is gripped by a user for trigger operation, hand positioner 54 is in pressure contact with dorsal web 56 during spraying operations. The range of distances are between ⅝ inch and 2 inches and preferably are between 1 inch and 1½ inch. Hand positioner 54 includes a bottom wall 64 that extends from mounting portion 44 to contact with dorsal web 56 during spraying operations. Hand positioner 54 has a distal end 66 relative to front portion 48, and bottom wall 64 is concavely curved in the longitudinal direction between mounting portion 44 and distal end 66.

Hand positioner 54 includes spaced parallel vertical side walls 68 with bottom wall 64 extending between and connected to side walls 68 and a downward sloping end top wall 65 connected to side walls 68. Housing 42 and hand positioner 54 are made of a plastic material.

As seen in FIGS. 3–7, an ergonomic trigger sprayer 34A analogous to ergonomic trigger sprayer 34 includes a hand-positioning member 54A analogous in all respects to the external aspects of hand positioner 54. Hand positioning member 54A is a separate unit from a housing 12A to which it is connected. Housing 12 is easily adapted from conventional housing 12 shown in FIG. 1, that is, it can be molded and produced essentially from a converted set of existing molds, and hand-positioning member 54A can be molded and produced from another set of molds. Hand-positioning member 54A is then connected to the rear end of housing 12A in the manner indicated in FIG. 3 where hand positioning member 54A is shown in a pre-mounted position a positioning member 54X as indicated in phantom line with distal end 66X and bottom wall 64X each slightly below their inserted positions indicated by distal end 66 and bottom wall 64. Thus, hand positioner 54 shown in FIG. 2 is also designated as hand-positioning member 54A in FIG. 2.

The distance from mounting portion 44 to distal end 66 of hand-positioning member 54A is in the general rang of ⅝ inch to 2 inches and preferably in the range of 1 inch to 1½ inches. In these ranges, when trigger sprayer 34 is gripped by the user for trigger operation, hand-positioning member 54A is in pressure contact with dorsal web 56 during spraying operations. Hand-positioning member 54A includes bottom wall 64 that is in contact with dorsal web 56 of the hand 58 of the user during spraying operations. Hand positioning member 54A also includes spaced parallel vertical side walls 68 which are connected to bottom wall 64 which extends between and is connected to side walls 68. Bottom wall 64 wall is concavely curved in a longitudinal direction from its abutment against mounting portion 44 and distal end 66. Bottom wall 64 is also concavely curved in a transverse direction relative to the longitudinal direction.

Figures 3, 4:
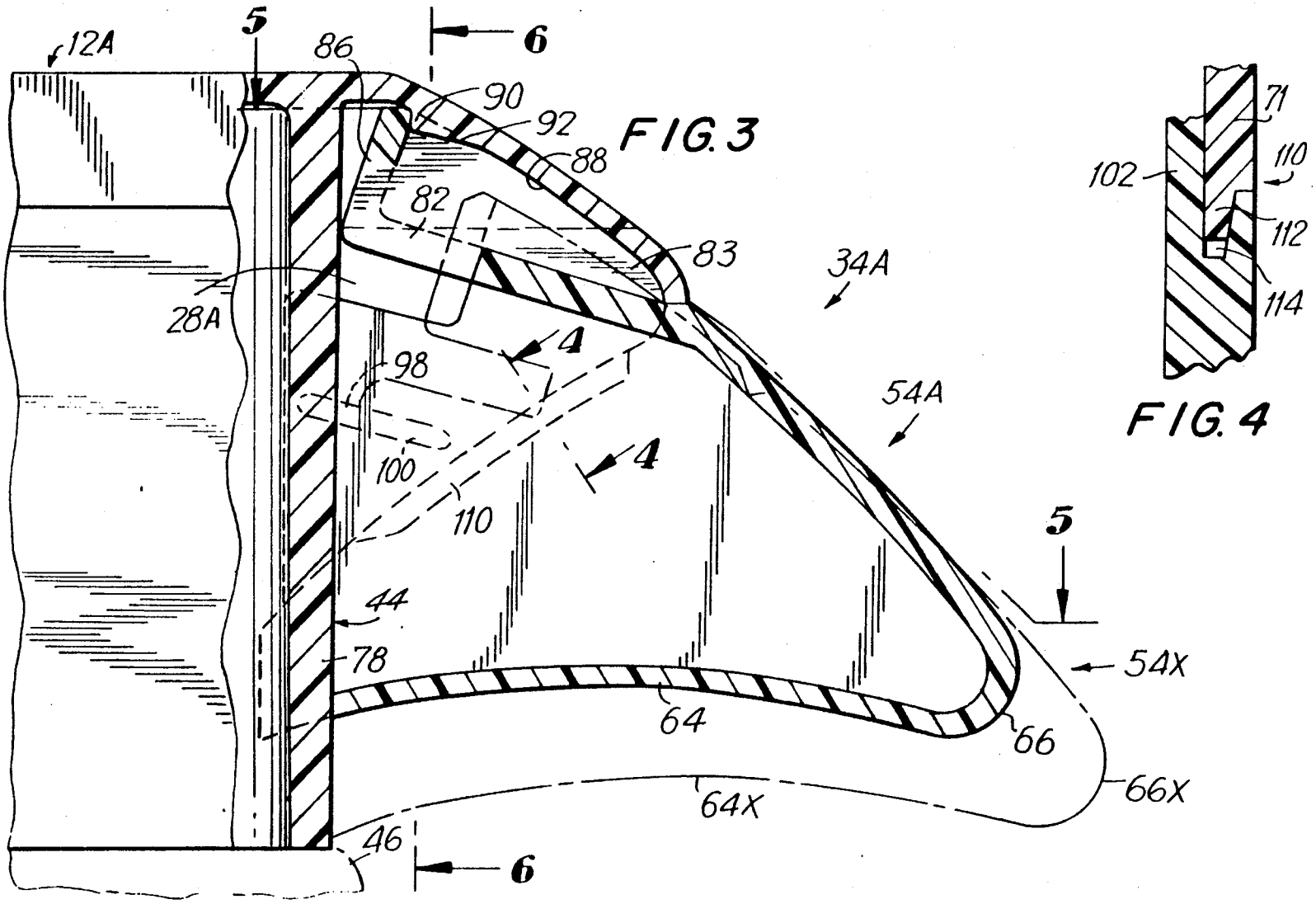
FIG. 3 is a sectional view taken through plane 3—3 of FIG. 2.
FIG. 4 is a sectional view taken through plane 4—4 of FIG. 3 showing the tongue-and-groove connection between the housing wall and the hand positioner.
Figure 5:
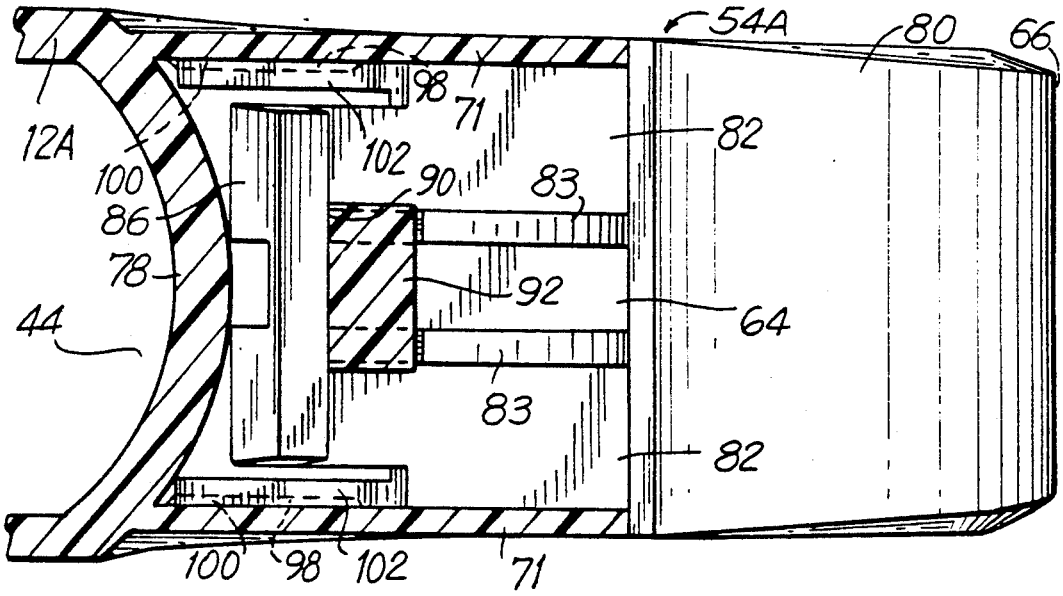
FIG. 5 is a sectional view taken through plane 5—5 of FIG. 3.
Figure 6:
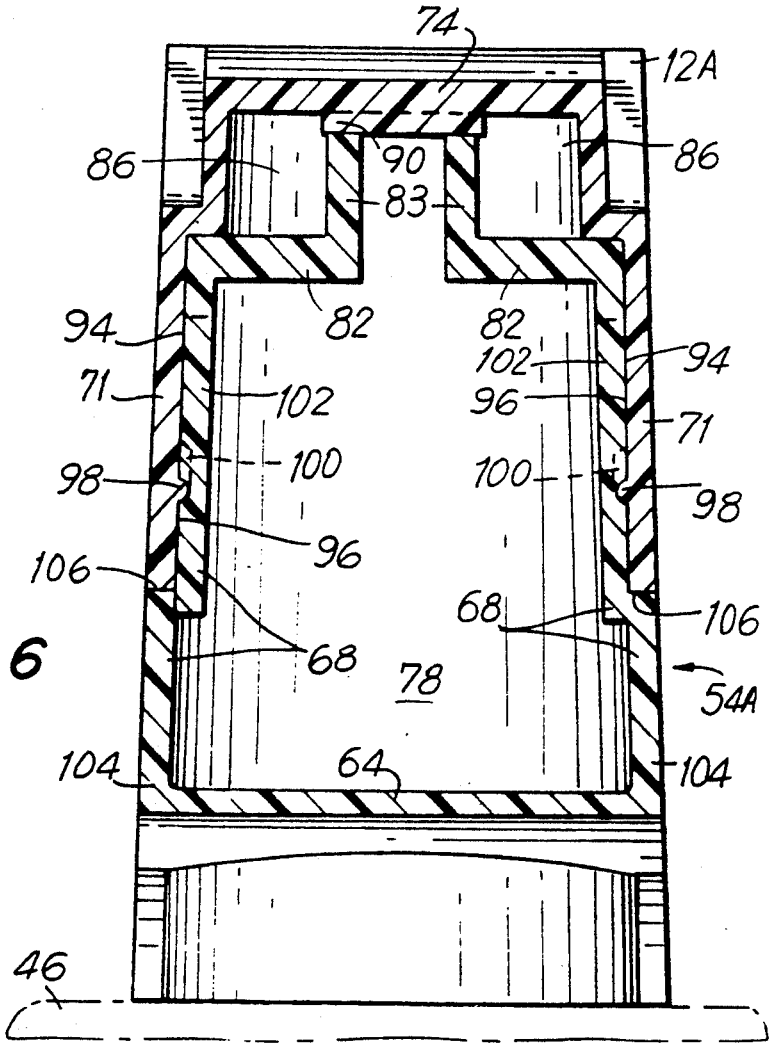
FIG. 6 is a sectional view taken through plane 6—6 of FIG. 3.

Rear portion 50 of housing 12A includes opposed spaced vertical housing side walls 71 and a top wall 74, which is angled downwardly rearwards, connected to housing side walls 71. Housing side walls 71 and housing top wall 74 define a recess 28A, which is analogous to recess 28 shown in FIG. 1. Recess 28A is also in part defined by vertical cylindrical rear wall portion 78 of mounting portion 44 of housing 12A. As shown in FIGS. 3, 5, and 6, hand-positioning member 54A is positioned within recess 28A.

Hand-positioning member 54A includes an angled top wall 80 including a top wall portion 82 at the forward portion of top wall 80. A connecting mechanism for locking hand-positioning member 54A to housing 12A includes forward top wall portion 82 having a snap-on element 86 and top wall 74 of housing 12A having an inner surface 88 having a keeper element 90 for engaging snap-on element 86 so that hand-positioning member 54A is connected to housing 12A in such a manner that hand-positioning member 54A cannot be removed, that is, is locked to housing 12A. Biasable top wall 82 includes a pair of vertically upwardly extending spaced parallel walls 83 having sloped top sides which connect at their inner ends to keeper element 90. In particular, top wall portion 82 is biasable and movable between unbiased and biased modes. A ramp 92 extending from to keeper element 90 from inner surface 88 of top wall 74 is for pressing snap-on element 86 and biasable top wall portion 82 from the unbiased mode to the biased mode during mounting hand-positioning member 54A into recess 28A until snap-on element 86 engages keeper element 90 and biasable top wall portion 82 returns to the unbiased mode so that hand-positioning member 54A is locked to housing 12A within recess 28A.

As seen best in FIG. 6, side walls 71 of housing 12A have inner side surfaces 94, and side walls 68 of hand-locating member 54A have outer side surfaces 96 and mounting guides associated with inner side surfaces 94 and outer side surfaces 96 are used for connecting hand-positioning member 54A within recess 28A during the mounting of hand-positioning member 54A within recess 28A. In particular, the guide means include inner side surfaces 94 having opposed ribs 98, and outer side surfaces 96 forming grooves 100 which slidably engage with ribs 98 during mounting of hand-positioning member 54A within recess 28A.

Figure 7:
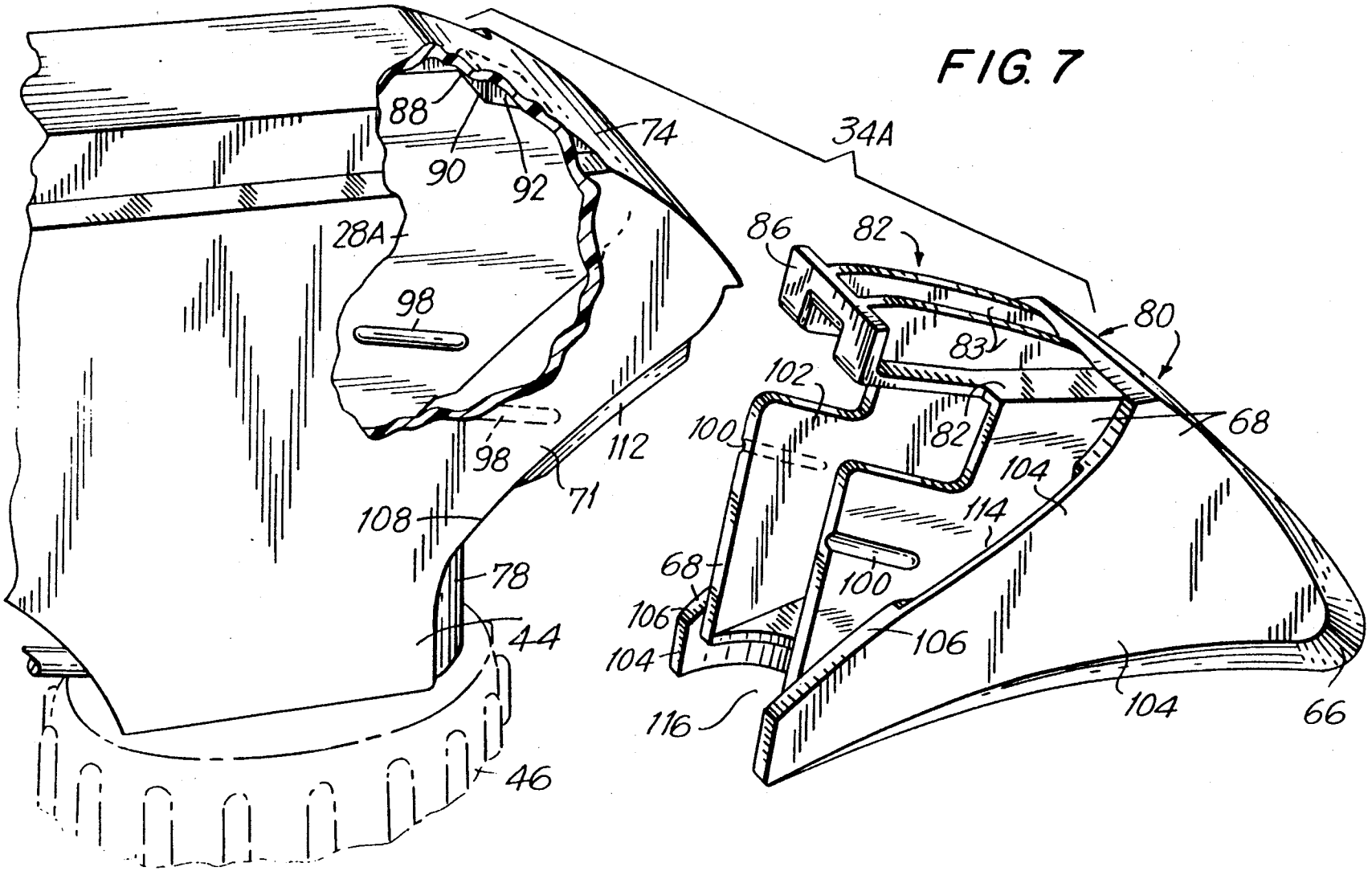
FIG. 7 is a broken away perspective view of a modified housing and an ergonomic hand positioner in position for being mounted to the housing.

FIG. 7 illustrates hand-positioning member 54A spaced from housing 12A in preparation for insertion into recess 28A to complete the assembly of ergonomic trigger sprayer 34A. Side walls 68 of hand-positioning member 54A will come into connection with side walls 71 of housing 12A. Side walls 68 comprise inner and outer portions 102 and 104, respectively, with inner portions 102 being positioned within recess 28A and outer portions 104 being positioned outside recess 28A. Steps, or ledges, 106 are located between inner and outer portions 102 and 104, and bottom edges 108 of side walls 71 are positioned along ledges 106 so that outer surfaces 96 of side walls 68, specifically of outer portion 104, are aligned with outer surfaces 94. Ledges 106 and said bottom edges 104 are preferably configured as tongue-and-groove assemblies as shown in FIG. 4, with tongues 112 extending downwardly from bottom edge 108 into grooves 114 of defined by side walls 71 along ledges 106. Bottom wall 64 of hand-positioning member 54A has an inner end defining a partially circular cavity 116 positioned around cylindrical rear wall portion 78 of mounting portion 44.

Figure 8:
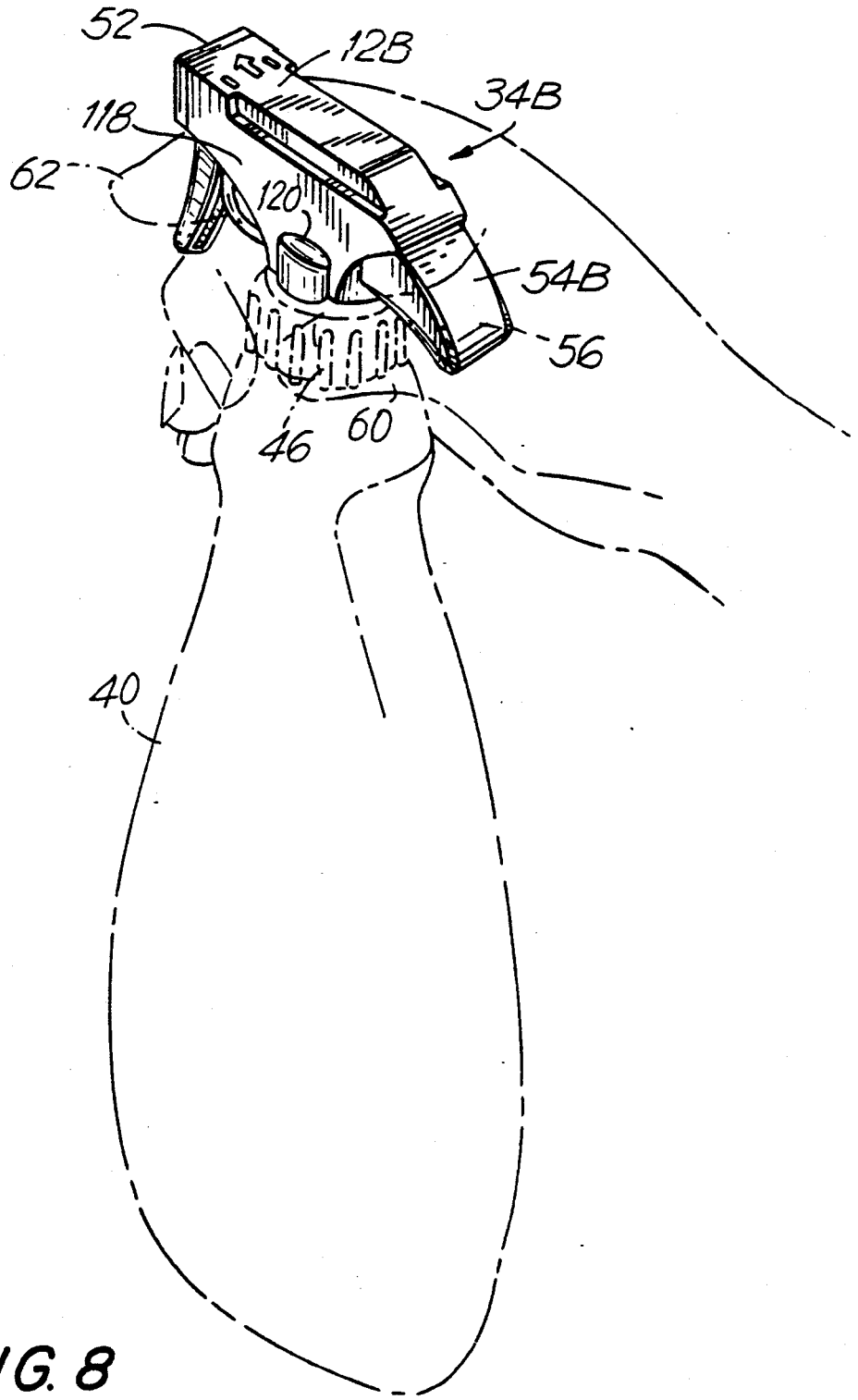
FIG. 8 is a perspective view of a trigger sprayer according to the present invention with a hand-positioning member connected to a conventional housing like the one shown in FIG. 2 but having a slight bulge at the mounting portion.

FIG. 8 illustrates an ergonomic trigger sprayer 34B analogous to ergonomic trigger sprayer 34A having a conventional housing 12B analogous to housing 12A having a mounting portion 118 having opposed outwardly extending walls 120 for accommodating a spraying mechanism (not shown) of a particular design that is similar but not identical with the spraying mechanism covered by housings 12 and 12A described previously. Housing 12B is connected to a hand-positioning member 54B that is identical with hand positioner 54A described previously.

Ergonomic trigger sprayers 34A and 34B are produced in accordance with the following steps:

a. Producing a housing 12A or 12B for covering the spraying mechanism for the trigger sprayer, housing 12A or 12B having a front end and an opposed rear end 70 and a mounting portion 44 for connecting to a liquid container positioned between the front end and rear ends 70 covering the nozzle of the sprayer and rear end 70 having an angled rear housing top wall 74 joined to a pair of opposed vertical rear housing side walls 71, housing top wall 74 and housing side walls 71 defining a recess 28A having an open bottom side, housing top wall 74 having a top wall inner surface 88 having a first connecting element, preferably keeper 90.

b. Producing a separate hand-positioning member 54A having a bottom wall 64A connected to opposed vertical side walls 71, which are connected to a top wall 80, and a second connecting element, preferably snap-on element 86.

c. Inserting hand-positioning member 54A into recess 28A of housing 12A or 12B until the first and second connecting elements 90 and 86 interlock so that separate hand-positioning member 54A is non-removably joined to housing 12A or 12B wherein hand-positioning member 54A functions to achieve pressure contact with the dorsal web 56 of the hand 58 of a user between the thumb 60 and the index finger 62 when the user grips housing **12*a* or 12B and the container to which housing 12*a* or 12B will be attached and pulls the trigger wherein the container and hand 58 and wrist 61** of the user ar held in alignment during spraying operations.

Step 1 (a) includes rear portion 50 of housing 12A or 12B being within an approximate range of distances from mounting portion 44, with the result that when the liquid sprayer is gripped by the user for trigger operation, hand-positioning member 54A is in pressure contact with dorsal web 56 of hand 58 of the user between thumb 60 and index finger 62 of the user during spraying operations. The mentioned range of distances are in general between ⅝ inch to 2 inches and preferably between 1 inch and 1½ inches.

Step 1(a) includes first connecting element 90 being housing top wall inner surface 74 having a keeper element 90 and a connecting ramp 92 sloping from top wall inner surface 74 to keeper element 90 in the direction toward the open bottom side; and wherein step 1 (b) includes second connecting element 86 being hand-positioning member 54A having top wall 80 having a biasable top wall portion 82 including snap-on element 86, and step 1 (c) includes the ramp pressing the snap-on member and the biasable portion from the unbiased mode to the biased mode until the snap-on member engages the keeper means, the hand-positioning member top wall returning to the unbiased mode wherein the hand-positioning member is locked to the housing within the recess 28A.

During step 1 (c) mounting guides associated with inner side surfaces 94 of side walls 71 and outer side surfaces 96 of hand-positioning member 54A contribute to-positioning member 54A within recess 28A. The mounting guides include a pair of grooves 98 defined in inner side surfaces 94 of housing side walls 71 and a pair of ribs 100 positioned on outer surfaces 96 of outer surfaces 96 of hand-positioning member 54A, ribs 100 sliding into grooves 98 during the mounting of hand-positioning member into recess 28A into connection with housing 12A during step 1 (c).

At the completion of step 1 (c) bottom edges 108 of housing 12A are positioned along ledges 106. Bottom edges 108 and ledges 106 are configured as tongue-and-groove assemblies with tongues 110 extending downwardly from bottom edges 108 into grooves 112 defined in ledges 106.

Mounting portion 44 includes cylindrical portion 78 bottom wall 64 of hand-positioning member 54A having an inner end defining partially circular cavity 116 being positioned around cylindrical portion 78 of mounting portion 44 at the conclusion of step 1 (c).

Although the present invention has been described in some detail by way of illustration and example for purposes of clarity and under standing, it will, of course be understood that various changes and modifications may be made in the form, details, and arrangements of the parts without departing from the scope of the invention set forth in the following claims.

What is claimed is:

1. An ergonomic trigger sprayer provided with a spraying mechanism including a nozzle for connection to a container, comprising, in combination, a housing having mounting means for attachment to the container, said housing enclosing the spraying mechanism and having opposed front and rear ends, said front end for enclosing the nozzle, said mounting means being located between said front and rear ends, hand positioning means for providing ergonomic pressure contact with the dorsal web of the user's hand between the thumb and the index finger when the user grips the container and pulls the trigger, and connecting means for non-releasably connecting said hand positioning means solely at said rear end of said housing.

2. The sprayer according to claim 1, wherein said housing defines a recess at said rear end, said ,hand positioning means being a hand-positioning member non-releasably connected to said rear end of said housing within said recess.

3. The sprayer according to claim 2, wherein said hand-positioning member extends rearwards to such a distance from said mounting means that when said liquid sprayer is gripped by the user for trigger operation, said hand-positioning member is in pressure contact with the dorsal web of the hand of the user between the thumb and the index finger during spraying operations.

4. The sprayer according to claim 3, wherein said hand-positioning member includes a bottom wall that is in contact with the dorsal web of the hand of the user during spraying operations.

5. The sprayer according to claim 4, wherein said hand-positioning member includes spaced parallel vertical side walls and said bottom wall extends between and is connected to said side walls.

6. The sprayer according to claim 5, wherein said hand-positioning member has a distal end and said bottom wall is concavely curved between said mounting means and said distal end.

7. The sprayer according to claim 6, wherein said hand positioning member has an end proximate said mounting portion, said distal end being no higher than said proximate end.

8. The sprayer according to claim 2, wherein said connecting means lock said hand-positioning member to said housing.

9. The sprayer according to claim 8, wherein said rear end of said housing includes opposed spaced housing side walls and a housing top wall connected to said housing side walls, said housing side walls and said housing top wall defining said recess.

10. The sprayer according to claim 9, wherein said hand-positioning member includes a hand-positioning member top wall, said housing top wall having an inner surface, said connecting means including said hand-positioning member having a top wall portion having a snap-on element and said housing top wall inner surface having keeper means for engaging said snap-on element wherein said hand-positioning member is connected to said housing.

11. The sprayer according to claim 10, wherein said hand-positioning member top wall portion is biasable and movable between unbiased and biased modes, and said top wall portion further including ramp means connected to said keeper means for pressing the snap-on member and the biasable portion from the unbiased mode to the biased mode during mounting said hand-positioning member to said housing in said recess until said snap-on member engages said keeper means and said hand-positioning member top wall returns to the unbiased mode wherein said hand-positioning member is locked to said housing within said recess.

12. The sprayer according to claim 2 or 9, wherein said housing has opposed spaced vertical side walls having inner side surfaces and said hand-positioning member has hand-positioning member side walls having outer surfaces, and further including guide means associated with said inner side surfaces and said outer side surfaces for positioning said hand-positioning member within said recess during mounting said hand-positioning member with said housing within said recess.

13. The sprayer according to claim 12, wherein said housing mounting means includes a cylindrical portion for securing the housing to the container and said hand-positioning member bottom wall has an inner end defining a partially circular cavity means positioned around said cylindrical portion.

14. The sprayer according to claim 11, wherein said hand-positioning member side walls have outer surfaces and said housing side walls have outer surfaces in alignment with said hand-positioning member side walls outer surfaces.

15. The sprayer according to claim 14, wherein said housing side walls have housing bottom edges and said hand-positioning member side walls have inner sections positioned within said recess and outer sections positioned outside said recess, said hand-positioning member side walls having ledges between said inner and outer sections, said housing bottom edges being positioned along said ledges.

16. The sprayer according to claim 15, wherein said ledges and said bottom edges are configured as tongue-and-groove assemblies.

17. An ergonomic trigger sprayer comprising:

a housing for covering the spraying mechanism for the trigger sprayer, the housing having a truncated rear portion defining a recess at its rear end and including a first connecting element; and a separate hand-positioning member having a bottom wall connected to a downwardly angled top wall, the bottom and top walls being connected to opposed vertical walls, and including a second connecting element;

said hand-positioning member being positioned in the recess of the housing with said first and second connecting means interlocking, wherein said separate hand-positioning member is non-removably joined to said housing, wherein the hand-positioning member functions as hand positioning means for achieving pressure contact with the dorsal web of the hand of a user between the thumb and the index finger when the user grips the housing and the container to which the housing will be attached and pulls the trigger.

18. The trigger sprayer according to claim 17, wherein said rear portion of said housing has a top wall having an inner surface, said first connecting element having a keeper element extending from said inner surface, and said hand-positioning member having having a top wall including a biasable top wall portion, said second connecting element including said biasable top wall portion and further including a snap-on element connected to said top wall portion, said snap-on element engaging said keeper element in interlocking relationship, said keeper element pressing said snap-on element and said biasable portion from the unbiased mode to the biased mode until said snap-on element engages keeper element, said top wall portion returning to the unbiased mode when said snap-on element during assembly.

19. The trigger sprayer according to claim 18, further including a ramp connected to inner surface of said top wall and leading to said keeper element wherein said snap-on element is pressed into said biased mode by said ramp during assembly.

* * * * *